US012642317B2

(12) United States Patent
Green

(10) Patent No.: US 12,642,317 B2
(45) Date of Patent: Jun. 2, 2026

(54) CONVERTIBLE SKIRT/T-SHIRT/DRESS

(71) Applicant: Jennifer Lee Green, Hainesport, NJ (US)

(72) Inventor: Jennifer Lee Green, Hainesport, NJ (US)

( * ) Notice: Subject to any disclaimer, the term of this patent is extended or adjusted under 35 U.S.C. 154(b) by 0 days.

(21) Appl. No.: 18/606,370

(22) Filed: Mar. 15, 2024

(65) Prior Publication Data

US 2025/0288033 A1 Sep. 18, 2025

(51) Int. Cl.
*A41D 15/00* (2006.01)
*A41D 27/20* (2006.01)
*A41F 1/00* (2006.01)

(52) U.S. Cl.
CPC ..... *A41D 15/00* (2013.01); *A41D 27/201* (2013.01); *A41F 1/00* (2013.01)

(58) Field of Classification Search
CPC ..... A41D 15/00; A41D 27/201; A41F 1/00
See application file for complete search history.

(56) References Cited

U.S. PATENT DOCUMENTS 2,705,326 A * 4/1955 Lahnstein ..... A41D 10/00 2/269
2,825,905 A * 3/1958 Merl ..... A41D 15/00 D2/757
3,665,516 A * 5/1972 Orovan ..... A41D 15/002 2/269
4,377,007 A * 3/1983 Sudjian ..... A41D 15/002 2/105
4,697,288 A * 10/1987 Palumbo ..... A41D 15/002 2/919
4,866,791 A * 9/1989 Carver ..... A41D 1/18 2/113
5,079,779 A * 1/1992 Spector ..... A41D 15/00 2/106
9,364,035 B1 * 6/2016 Shachaf ..... A41D 15/00

FOREIGN PATENT DOCUMENTS

FR 3033986 A1 * 9/2016 ..... A41D 15/00

OTHER PUBLICATIONS

FR 3033986 (English Translation), Rodier Julie, Convertible clothing in skirt with sleeves, Sep. 30, 2016.*

* cited by examiner

*Primary Examiner* — Tajash D Patel
(74) *Attorney, Agent, or Firm* — Israel Nissenbaum; Yitzy Nissenbaum

(57) ABSTRACT

A convertible garment of a T-shirt and skirt. The skirt configuration comprises a skirt body section extending from a wearer's waist downward and has two invertible pockets with closed ends of the pockets configured to be selectively opened and closed by openable closure elements. The skirt has a waist opening capable of being reduced or maintained in opening dimensions for the waist opening to function as a neck hole in the T-shirt configuration. The convertible garment is configured to be reversibly converted from the skirt configuration to that of a configuration of a sleeved T-shirt with extraction and inversion of the pockets and opening of ends of the pockets, forming arm-passable sleeves and the body of the skirt is converted to a torso covering T-shirt body. Extension elements enable variable length conversion of the skirt and for the T-shirt to become a sleeved dress. Total inversion provides different decorative appearances.

10 Claims, 4 Drawing Sheets

CONVERTIBLE SKIRT/T-SHIRT/DRESS

FIELD OF THE INVENTION

This invention relates to convertible garments having multiple different functions and particularly to garments which are convertible between a skirt and a T-shirt or dress with extendible sleeves and hem lengths.

BACKGROUND

Convertible garments are an entire class of clothing wherein a garment may be either shortened or lengthened by fasteners or with addition of clothing elements or sleeves with fasteners such as snaps or zippers. In another type of convertible garments, a garment is converted to another type of garment (usually of a loose-fitting design). Garments having components for a particular use are also converted whereby the components are utilized for a different garment use. As used herein, "skirts" are articles of clothing which peripherally enclose a wearer's body and which generally extend from the wearer's waist and extend toward the wearer's knees with a terminal hem above, below and at the knee in various configurations commonly referred to as "mini", "midi" or "maxi" and "knee-length" skirts. A T-shirt is an upper body garment which peripherally encloses a wearer's torso and in classical form has extending sleeves which define the garment as having a "T" shape. In normal human physiology, the distance from a neck to a waist and from the waist to the knees is very roughly the same.

SUMMARY

It is an object to provide a convertible garment whereby pockets of a particular garment are converted into sleeves for a different garment use.

It is a further object to provide a convertible garment with a waist component opening of one garment use being converted into a neck opening of a converted garment and a portion adjacent the neck opening is converted to a shoulder segment.

It is a still further object to provide convertible garments which are invertible to become convertible garments with different designs or colors.

It is yet another object to provide an embodiment wherein a skirt is convertible to a sleeved T-shirt and reversed and wherein in a dual conversion, the skirt is convertible to a sleeved dress.

In other embodiments, it is an object to provide adjustable sleeve lengths, pocket depths and hem lengths.

Generally, the present invention comprises a convertible garment comprising either a T-shirt or a skirt. The skirt configuration of the garment comprises:

a) skirt body section configured to extend from a wearer's waist downward;

b) at least two invertible pockets extending within the body section, with closed ends of the pockets being configured to be selectively opened and closed by various openable closure elements for opening and inversion to form sleeves in the T-shirt configuration, and c) a waist opening capable of being reduced or maintained in opening dimensions suitable for the waist opening to function as a neck hole in the T-shirt configuration.

The convertible garment is further configured to be converted from a skirt configuration to that of a configuration of a sleeved T-shirt with extraction and inversion of the pockets and opening of the ends of the pockets to form arm-passable sleeves and the body of the skirt is thereby converted to a torso covering T-shirt body.

In embodiments of the convertible garment, depending on starting configuration, the garment comprises either a T-shirt or a skirt. With the skirt configuration the garment comprises at least two invertible pockets extending therewithin, with closed ends of the pockets being configured to be selectively opened and closed by various openable closure elements. In embodiments the pocket closures are provided with openable lock elements or structures to prevent accidental opening. The skirt has a waist opening capable of being reduced or maintained in opening dimensions suitable for the waist opening to function as a neck hole. The convertible garment is further configured to be converted from a skirt configuration to that of a second configuration of a sleeved T-shirt with extraction and inversion of the pockets and opening of the ends of the pockets to form arm-passable sleeves and the body of the skirt is thereby converted to a torso covering T-shirt body. In embodiments, length extensions further enable the T-shirt configuration to become a sleeved dress, with variations in sleeve length or a skirt of various hem lengths (mini, midi or maxi). In further embodiments, the variable sleeve extension lengths are each provided with opening and closing fastening elements to permit the sleeves to become pockets of varying depths and sleeves of varying lengths.

An embodiment of the invention comprises a convertible garment which is convertible between a skirt and a sleeved T-shirt. In such embodiment, the skirt includes at least two pockets having openable and re-closable bottom ends (such as with drawstrings, hook and eye fasteners, snaps, etc.) and the distance from the periphery of the waist opening to the top of the pocket is sized for fitting on the shoulder of a wearer. In another embodiment, the sleeves may extend directly from the side peripheries of the neck hole (nee waist opening) with the original pockets extending from the top of the skirt and not spaced from the waist opening.

Depending on the disparity between waist opening of the skirt and the neck of the T-shirt with the former being invariably larger, the waist/neck opening may be provided with various expedients such as with an elastic periphery which may stretchably accommodate either body part, either snugly or loosely, with other similar expdients being possible. In another embodiment, a drawstring may be used to constrict or open the waist/neck opening. These convertible garments enable a traveler to carry half or a quarter (with reversibility) the amount of clothing and further enables the extension of wardrobes, particularly for children who require numerous clothing purchases, with growth.

For aesthetic purposes, inverted seams are, in some embodiments, decoratively stitched to avoid a "wrong side" appearance. Similarly, for skirt zippers, they are, in embodiments aesthetically covered with fabric flaps on both sides or are provided with dual sided zipper pulls.

In an embodiment, a conversion from skirt to T-shirt is effected by a process of pulling out the pockets of the skirt with inversion, with depth of pockets being generally determinative of T-shirt sleeve length. The bottom ends of the pocket are provided with openable fasteners which are opened to permit arm extension therethrough with such fasteners being aesthetically configured to be hidden or used as a decorative element of the T-shirt to which the skirt is converted. In some embodiments the fasteners or other included elements are used to adjust sleeve length or sleeve appearance. The fasteners may be positioned either inside the sleeve to provide a uniform appearance or outside the sleeve to provide a cuff of variable length. In the inverse positioning, such length adjustment is similarly applicable to adjusting pocket depth providing that the sleeve is closed thereby, to function as a pocket. The garment is then donned as a T-shirt. For the reverse conversion, the procedure is reversed. The garment may also be reversed while being worn provided that it includes a configuration (such as loosening draw string) to enable the waist/neck opening to be varied for being drawn over the torso of the wearer.

In some embodiments, the T-shirt, with extendable bottom hem, is able to be transformed into a sleeved dress with various hem and sleeve lengths. The same extendable bottom hem is usable to vary skirt length.

In a secondary inversion embodiment, the T-shirt and skirt and sleeves/pockets may be further completely inverted to provide exposure of obverse sides of the T-shirt and skirt whereby the garment becomes a reversible one with a different decorative appearance to provide a single garment serving the function of at least four to six different garments of T-shirts, skirts and dresses.

In further embodiments the T-shirt/skirt convertible garment is ideal as beach wear for sunning with sufficient cover up for various desired configured garments as a T-shirt with length sufficient to be a short dress and a skirt of various lengths. Smaller versions are utilizable for children with facilitated use in changing types of garments.

Material composition of the convertible garment is most conveniently of a stretchable fabric such as known by the trademarks Lycra or Spandex which permits ready conversion between waist/neck configuration. Other garment materials are however similarly utilizable with size accommodation expedient such as snaps, hook and eye fasteners, draw strings and even buttons and catches.

The above and other objects, features, and advantages of the invention will become more evident from the following discussion and drawings in which:

SHORT DESCRIPTION OF THE DRAWINGS

FIG. 3 shows the garment in T-shirt configuration with one sleeve being closed and the other in the process of being inverted and tucked in;

DETAILED DESCRIPTION

Figure 1:
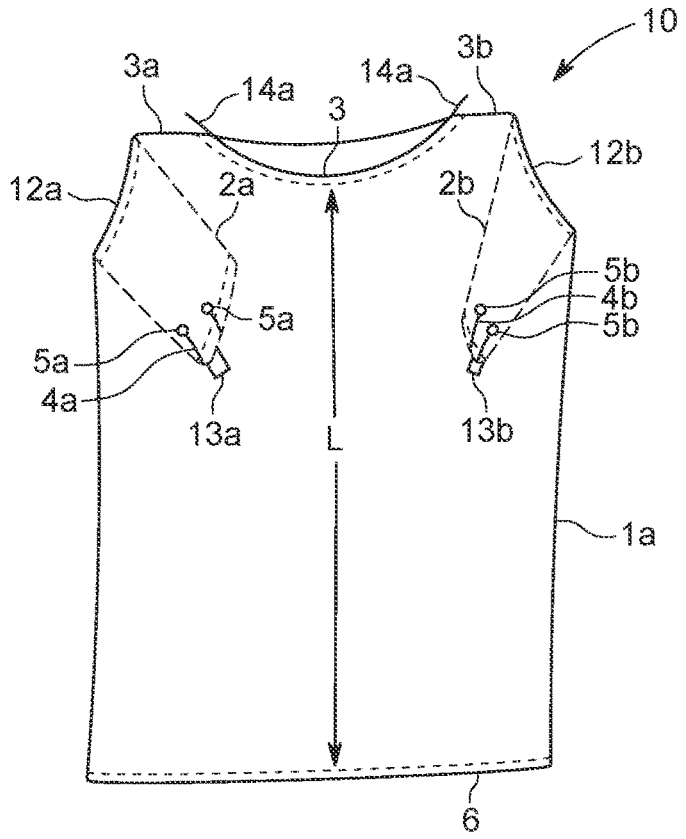
FIG. 1 is the garment shown in the skirt configuration with inverted closed sleeves as pockets within the skirt, shown in dashed lines.

With reference to the drawings, FIG. 1 depicts the convertible garment 10, in the skirt configuration, with a main body 1*a*, lower hem 6 and upper waist opening 3. Folded-in pockets 2*a* and 2*b*, shown in dashed lines, have their respective ends closed by drawstrings 4*a* and 4*b* to enable the pockets to function as retention elements. The pockets are spaced from the waist opening 3 by sections 3*a* and 3*b* which become vertical when worn and space the pocket openings 12*a* and 12*b* from the waist opening 3. Generally, the length L of the main body 1*a* (shown in FIGS. 1 and 2) is roughly the same as the distance from the waist to the knees of a wearer (mini, maxi or midi lengths can provide variations) in the skirt configuration. Conversion to T-shirt configuration 10*a*, as shown in FIG. 2, provides normal T-shirt dimensions and appearance.

Figure 2:
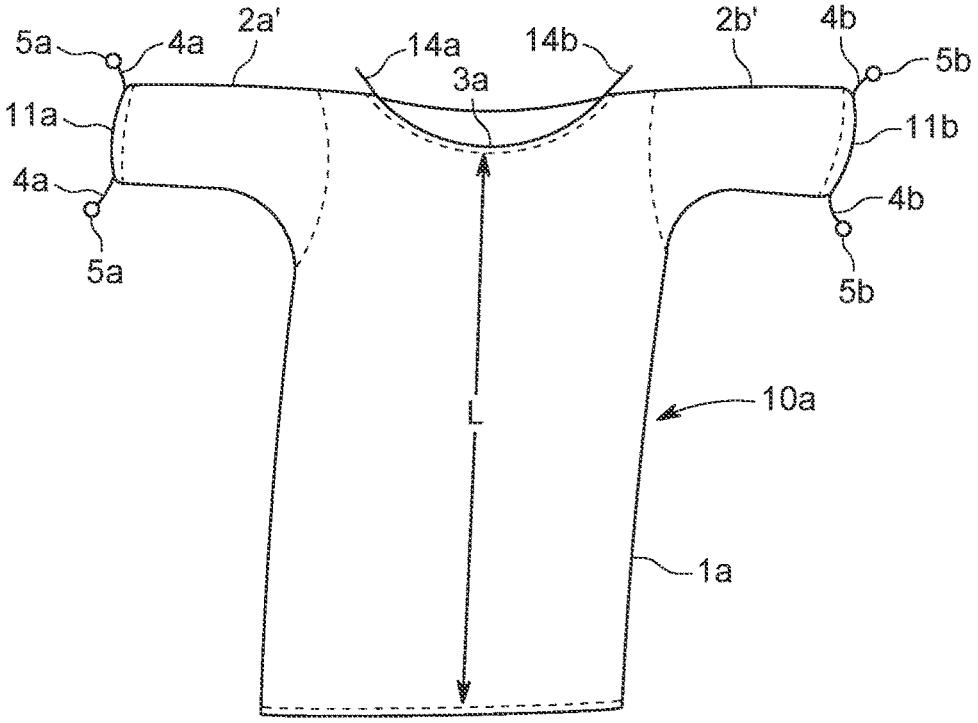
FIG. 2 is the garment herein in a T-shirt configuration with outstretched extended opened pockets as sleeves.
Figure 3:
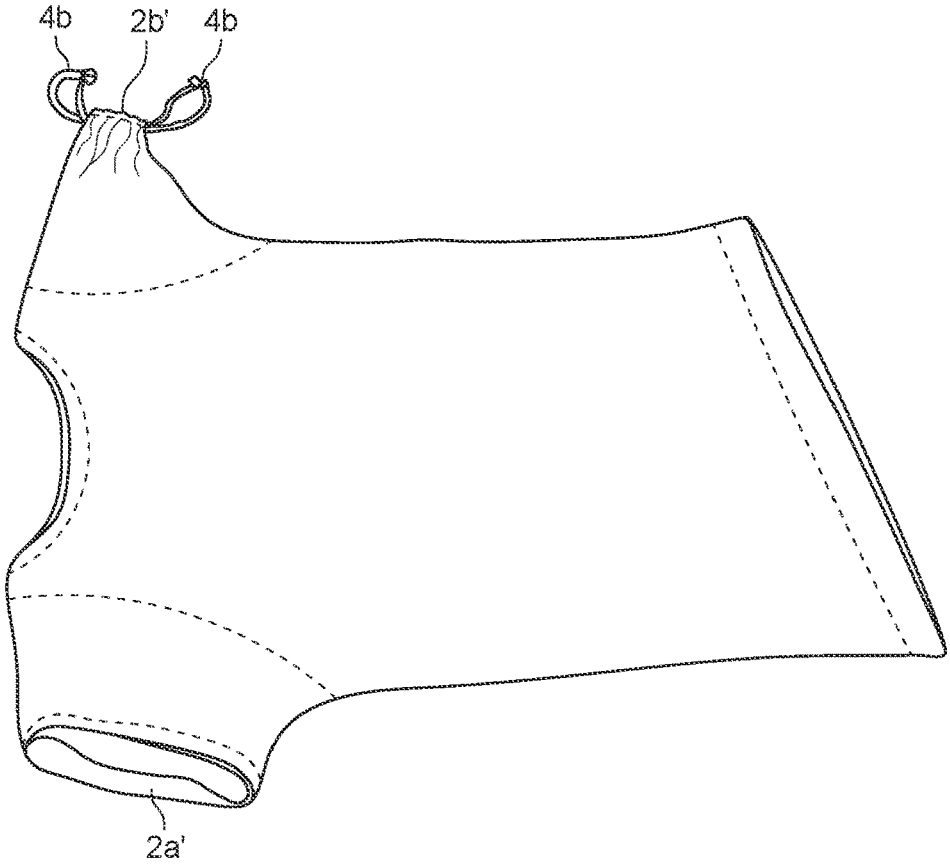
Figure 4:
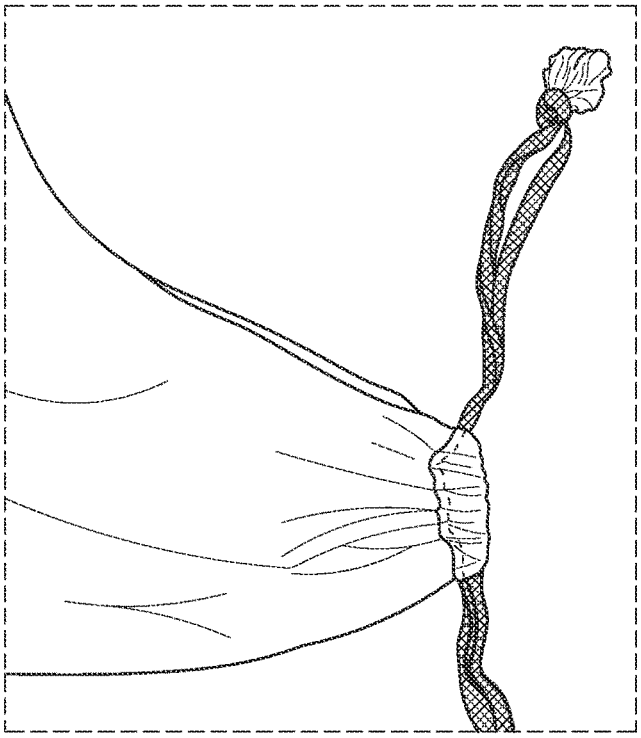
FIG. 4 is an enlarged view of the sleeve shown in FIG. 3 being closed to form a pocket after inversion.

As shown in FIGS. 2 and 3, conversion of the T-shirt 10*a* to that of a skirt 10 is effected by pulling end drawstrings 4*a* and 4*b* of sleeves 2*a*' and 2*b*' (sleeve 2*b*' is shown in FIG. 4 as being converted from an open sleeve to a closed pocket with pulled drawstring 4*b*). Once the sleeves 2*a*' and 2*b*' are closed into pocket formation, they are inverted (pocket 2*a*—nee sleeve 2*a*', as shown in FIG. 3) and fully tucked into the main body 1*a*, as shown in FIG. 1 to form a skirt 10 with slash pockets 12*a* and 12*b*. Clips 13*a* and 13*b* (or other similar openable locking elements such as perforated beads movable on the drawstring for closure and opening) help ensure that the drawstrings 4*a* and 4*b* remain closed and unloosened to maintain integrity of the pockets.

Reversal of the procedure is effected with inverting and pulling out of the pockets 2*a* and 2*b*. Clips 13*a* and 13*b* are removed. Then drawstrings 4*a* and 4*b* are loosened to open the ends of pockets 2*a* and 2*b* thereby permitting the pockets 2*a* and 2*b* to be converted to form arm pass-through sleeves 2*a*' and 2*b*' transforming the skirt 10 into a sleeved T-shirt 10*a*, as shown in FIG. 2.

Drawstrings 4*a* and 4*b* are drawn in with minimal extension. If desired, the end lengths of the drawstrings may remain extended as decorative tassels 5*a* and 5*b* (in the T-shirt configuration and hidden in the skirt configuration). Alternatively hidden fasteners such as snaps and hook and eye fasteners may be utilized. Other openable fasteners may similarly be used to effect sleeve closures into pockets with reversal into sleeves, as desired.

With conversion of the skirt 10 to T-shirt 10*a*, adjustable waist opening 3 is converted to a neck opening 3*a*, shown in FIG. 2, with size adjustment being effected with either an embedded elastic (not shown) which stretchably accommodates the dimensions of neck and waist or, as shown, drawstrings 14*a* and 14*b* permitting selective variations in neck size opening and waist size opening. Other size changing or cinching elements may be utilized or even simple a wide neck opening which remains as a waist accommodating size.

Figure 5:
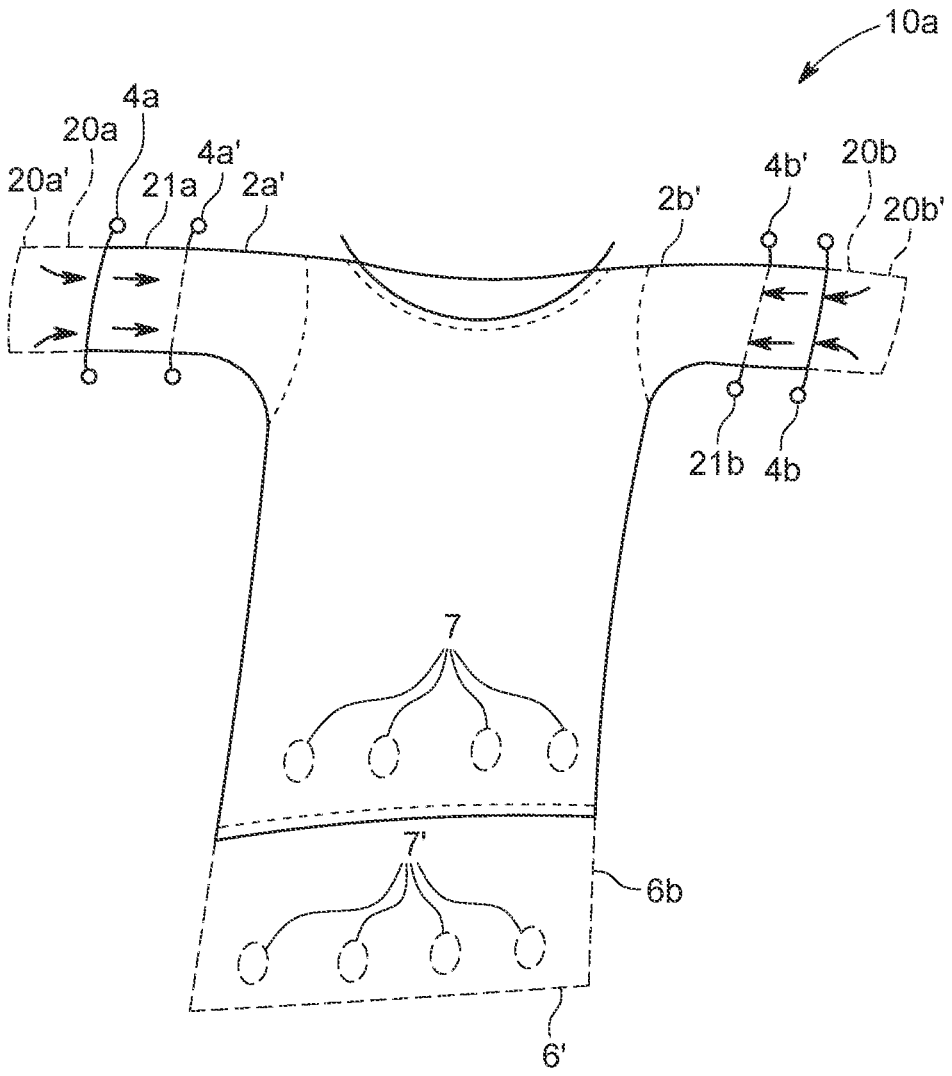
FIG. 5 shows the T-shirt configuration of FIG. 1 with an extension section to form a sleeved dress configuration and fasteners shown in dashed lines for hemming up to form the T-shirt configuration and sleeve length adjustment elements.

In variation embodiments, versatility of the convertible garment is further enhanced. Pocket depths are generally relatively shallow (for ready access to contents) and T-shirt sleeves are generally short (for style and since some are worn under other garments with longer sleeves). However, if longer sleeves are desired for the T-shirt configuration, as shown in FIG. 5, extra tubular lengths 20*a* and 20*b*, folded and tucked into sleeves 2*a*' and 2*b*' and fastened with their respective ends 20*a*' and 20*b*' to the inner walls of the pockets (alternatively length 20*a* and 20*b* are turned outwardly onto sleeves 2*a*' and 2*b*' as cuffs). Sleeve/pocket end drawstrings 4*a* and 4*b* are positioned at the fold point for formation of pockets in the skirt configuration. Tubular lengths 20*a* and 20*b* require no end fasteners and can be inverted straight outwardly, in the T-shirt configuration, to increase sleeve length. Sleeve lengths 21*a* and 21*b* similarly provide for the option of decreasing sleeve lengths and can be provided with their own separate drawstrings for providing shallower pockets for the converted skirt form shown in FIG. 6.

Figure 6:
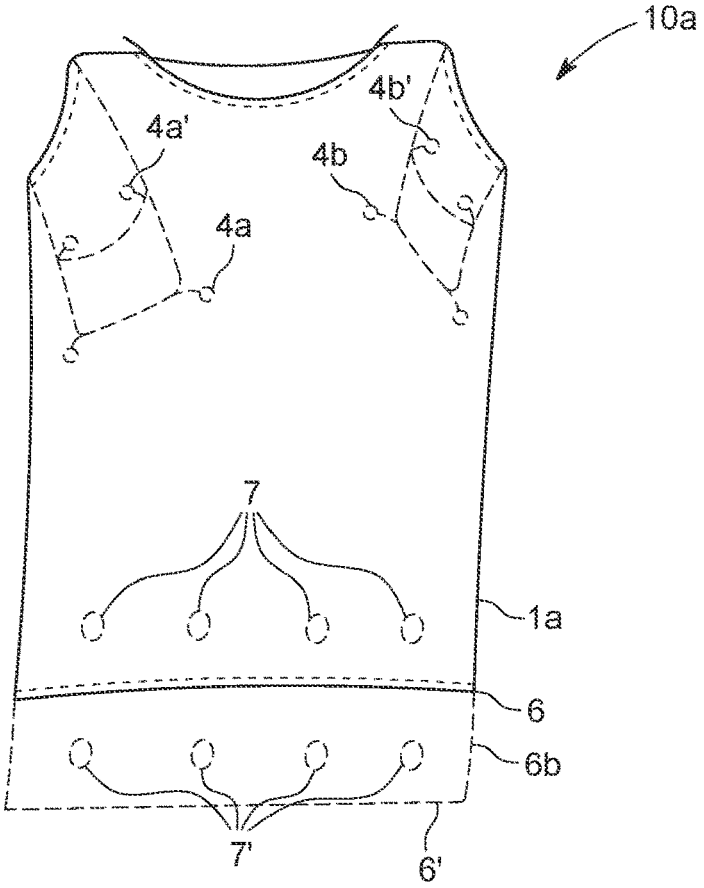
FIG. 6 shows the skirt configuration of FIG. 2 with hem lengthening and pockets shortening elements.

Similarly skirt length may be increased by the addition of tubular section 6*b* as shown in FIG. 6, which is initially folded at first hem position 6 into the skirt body 1*a* and fastened to the inner wall thereof such as with snap fasteners 7 and 7'. Skirt length is increased by unfolding section 6*b* to provide a second longer hem section 6'. Further inclusion of hem extensions permits the skirt to be configured from common mini to knee length, midi or maxi length appearances.

Selective unfolding of sleeve extensions and hem extensions enables the T-shirt 10*a* to be converted to dress configurations, shown in FIG. 5, with longer overall hem length and adjustment of sleeve lengths with modification of the T-shirt configuration.

Figure 7:
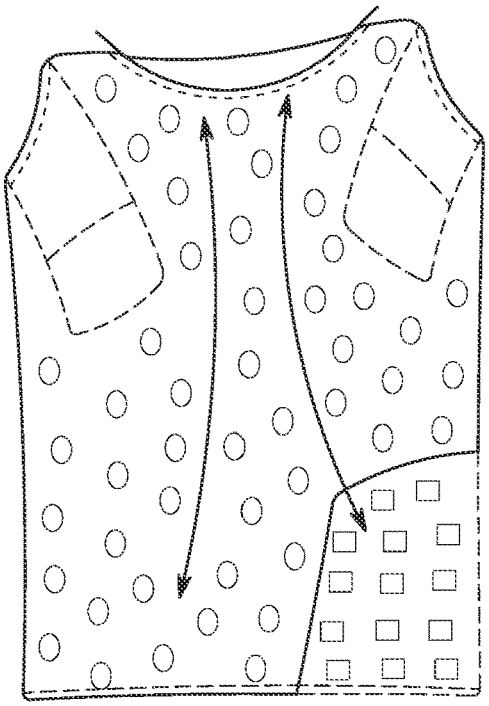
FIG. 7 schematically shows full inversion of the skirt/T-shirt to provide exposure of the obverse side of the garment in alternative appearance configuration.

FIG. 7 shows, by way of illustration and a obverse side different decorative appearance, the ability of the skirt 10 to be completely inverted to provide the skirt with different decorative appearance (e.g., polka dots and squares) and with conversion to a second T-shirt appearance. Similarly, though not shown, the T-shirt configuration may also be inverted to provide a secondary appearance. With both skirt and T-shirt, the respective pockets and sleeves are inverted as well, with their own respective appearances, as desired. With the complete inversions, seams made visible are either provided with covering elements such as flaps or are made decorative in appearance.

It is understood that variations in fasteners, configurations, garment and element structures, conversions, materials, decorative appearance and the like, are possible with the convertible garment disclosed herein without departing from the scope of the invention as defined in the following claims.

What is claimed is:

1. A convertible garment comprising, depending on starting configuration, either a T-shirt or a skirt, wherein with the skirt configuration the garment comprises:

a. skirt body section configured to extend from a wearer's waist downward;

b. at least two invertible pockets extending within the body section, with closed ends of the pockets being configured to be selectively opened and closed by openable closure elements for opening and inversion to form sleeves in the T-shirt configuration, c. a waist opening capable of being reduced or maintained in opening dimensions suitable for the waist opening to function as a neck hole in the T-shirt configuration, wherein the convertible garment is further configured to be converted from a skirt configuration to that of a configuration of a sleeved T-shirt with extraction and inversion of the pockets and opening of the ends of the pockets to form arm-passable sleeves and the body of the skirt is thereby converted to a torso covering T-shirt body, and wherein the invertible pockets/sleeves have base sections adjacent the body section and terminal closable openings defining an extended length for the pockets/sleeves and wherein the pockets/sleeves further comprise internal or external fastener elements along the length of respective pockets/sleeves, positioned and configured to enable an opened end section of the sleeves to be folded internally or externally over the base sections and fastened into position thereon with the internal or external fastener elements to provide adjustable length sleeves.

2. The convertible garment of claim 1, wherein the garment, in the T-shirt configuration, comprises a bottom hem wherein the hem is downwardly extendible into at least one extension section wherein the hem comprises a folded edge of the extension section and the garment, with the extension section being folded and fastened by fasteners within the convertible garment, and wherein the fasteners are released to permit downward extendible extension of the hem with release of the extension section, wherein with the extension section being extended, the T-shirt configuration is configured to be converted to a sleeved dress configuration.

3. The convertible garment of claim 1, wherein the neck hole in the T-shirt configuration is comprised of a drawstring capable of closely encircling the neck hole and being adjustable between a neck accommodating size to a waist accommodating size and from a waist accommodating size to a neck accommodating size.

4. The convertible garment of claim 1, wherein the garment is comprised of a stretchable material.

5. The convertible garment of claim 1, wherein the invertible pockets in the skirt configuration are openably closed at their respective free ends or closure section with any one of fastening elements of drawstrings, hooks, buttons, catches, clips, snaps and hook and eye fasteners.

6. The convertible garment of claim 5, wherein the drawstrings are held in a closed position by closure beads thereon.

7. The convertible garment of claim 1, wherein exterior and interior surfaces of the skirt and T-shirt and exterior and interior surfaces of the pockets and sleeves are decoratively configured whereby the entire garment is configured to be invertible to provide two sets of skirt and T-shirt pockets/sleeves invertible configurations.

8. The convertible garment of claim 7, wherein seams of the garment made visible with entire garment inversion are provided with covering elements or are decoratively configured.

9. The convertible garment of claim 1, wherein the opened end section of the sleeves are provided with a closure section at a position where the opened end section is folded whereby depth of pockets is made shorter when the garment is inverted from T-shirt to skirt configuration.

10. The convertible garment of claim 2, wherein the extension section is configured to be an extension section for the skirt when the garment is converted from T-shirt configuration to skirt configuration and wherein the skirt, in a mini configuration, is configured to be converted by being lengthened into any one of a knee length, midi or maxi skirt configuration.

* * * * *